United States Patent [19]

Brace

[11] Patent Number: 4,688,685

[45] Date of Patent: Aug. 25, 1987

[54] RACK ASSEMBLY FOR ELONGATED OBJECTS

[76] Inventor: Richard G. Brace, Two Maple La., Dover, Mass. 02030

[21] Appl. No.: 803,301

[22] Filed: Dec. 2, 1985

[51] Int. Cl.[4] ..... A47B 81/00

[52] U.S. Cl. ..... 211/70.5; 211/60.1

[58] Field of Search ..... 211/70.5, 13, 78, 60.1, 211/107, 129, 163, 196, 133, 62, 64, 68, 69.9, 70, 67, 69, 71

[56] References Cited

U.S. PATENT DOCUMENTS

| | | | |
|---|---|---|---|
| 321,624 | 7/1885 | McPherson | 211/70 |
| 505,320 | 9/1893 | Meadows | 211/64 |
| 712,428 | 10/1902 | Whitcomb | 211/64 |
| 1,065,381 | 6/1913 | Martin | 211/70 |
| 1,259,623 | 3/1918 | Herrick | 211/70 |
| 1,478,043 | 12/1923 | Matteson | 211/68 |
| 1,598,727 | 9/1926 | Jones | 211/60.1 |
| 1,761,088 | 6/1930 | Pryde | 211/68 |
| 1,860,925 | 5/1932 | Cranshaw | 211/60.1 |
| 2,158,623 | 5/1939 | Fischbacher | 211/64 |
| 2,376,955 | 5/1945 | Ball | 211/60.1 |
| 2,417,089 | 3/1987 | Sardo | 211/13 |
| 2,512,622 | 6/1950 | Fish | 211/64 |
| 3,116,730 | 1/1964 | Tingley | 211/60.1 |
| 3,722,652 | 3/1973 | Busch et al. | 194/64 |
| 3,777,895 | 12/1973 | Weinstein et al. | 211/163 |
| 3,826,378 | 7/1974 | Novak | 211/605 K |
| 3,874,512 | 4/1975 | Wegley | 211/163 |
| 3,927,923 | 12/1975 | Kimmel | 211/64 |
| 4,222,490 | 9/1980 | Wood | 211/605 K |
| 4,320,700 | 3/1982 | Stachowicz | 211/60.1 |
| 4,534,471 | 8/1985 | Zahn et al. | 211/163 |

FOREIGN PATENT DOCUMENTS

| | | | |
|---|---|---|---|
| 1335767 | 7/1963 | France | 211/70.5 |
| 1362876 | 9/1964 | France . | |
| 2424041 | 12/1979 | France | 211/70.5 |
| 17657 | of 1893 | United Kingdom | 211/64 |

*Primary Examiner*—Cornelius J. Husar
*Assistant Examiner*—Eric K. Nicholson

[57] ABSTRACT

A rack assembly for skis and ski poles or other elongated objects, the assembly comprising a base portion, a central member upstanding from the base portion, and lower and upper sprocket members mounted on the central member, each of the sprocket members having a plurality of outwardly extending receiving portions, the upper and lower sprocket members being of the same outside diameter, the receiving portions of the upper sprocket being disposed, in plan, between the receiving portions of the lower sprocket, with the base portion underlying all of the receiving portions.

3 Claims, 5 Drawing Figures

RACK ASSEMBLY FOR ELONGATED OBJECTS

BACKGROUND OF THE INVENTION

1. Field of the Invention

This invention relates to a rack assembly for retaining elongated objects, and particularly to a rack assembly for retaining elongated objects of different lengths, as for example, skis and ski poles.

2. Description of the Prior Art

Rack assemblies for the retention of elongated objects, such as skis and ski poles, are generally known. U.S. Pat. No. 3,826,378, issued July 30, 1974 to Warren D. Novak, for example, discloses a ski rack in which skis and ski poles are retained in circular sprocket-like members mounted on a central post. The arrangement is such that a pair of skis stored in the rack locks a pair of ski poles in the same section, such that the poles cannot be removed without first removing the skis.

French Patent No. 1,362,875, issued Sept. 23, 1964 to Cesare Castiglioni, discloses a ski rack for retention of skis and ski poles. The skis are inserted in slots in a bottom plate mounted on a central post and are held by clamps on an upper plate mounted on the central post. Between the clamps on the upper plate are located notches adapted to receive ski poles. There is no facility for locking the ski poles in place.

SUMMARY OF THE INVENTION

An object of the present invention is to provide a rack for elongated objects, such as skis and ski poles, in which skis and ski poles are stored securely and with a minimum of space required, and in which the skis and ski poles are accessible, each independently of the other.

Another object of the invention is to provide such a rack as may be easily broken down into relatively small components, facilitating storage in a compact and readily portable collection of components, and adapted for easy and rapid assembly.

With the above and other objects in view, as will hereinafter appear, a feature of the present invention is the provision of a rack assembly for elongated objects, the assembly comprising a base portion, a central member upstanding from a central portion of the base portion, a lower sprocket member mounted on the central member between the ends of the central member, and an upper sprocket member mounted on the central member nearer a free end of the central member than the lower sprocket member, each of the sprocket members having a plurality of outwardly extending receiving portions, each of the receiving portions comprising a hub portion and two separated, parallel, outwardly extending fingers, and closure means disposed on a first of the two fingers and adapted to reach the second of the two fingers to close a slot defined by the hub portion and the two fingers, the upper and lower sprocket members being of substantially equal outside diameter, the receiving portions of the upper sprocket being disposed, in plan, between the receiving portions of the lower sprocket, with the base portion underlying all of the receiving portions.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
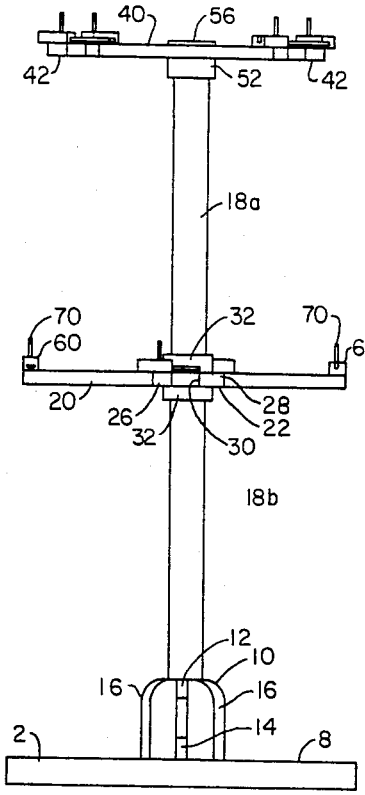
FIG. 1 is a side elevational view of one form of rack assembly for elongated objects, such as skis and ski poles, illustrative of an embodiment of the invention.
Figure 2:
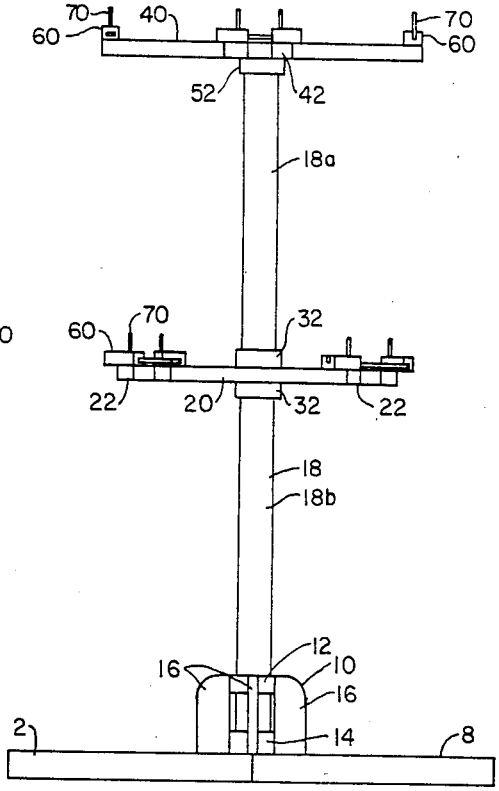
FIG. 2 is a quarter elevational view thereof.

Referring to the drawings, it will be seen that an illustrative embodiment of the rack assembly as used for skis and ski poles includes a base member 2 provided with an upper surface 4 inclined downwardly from a peripheral portion thereof to a central portion thereof. In a preferred embodiment, the base member 2 is substantially square in plan (FIG. 3) and is provided with a hole 6 near each corner for screws or bolts to facilitate permanent attachment to a floor. The peripheral portion of the base member is provided with an upstanding lip 8.

The assembly further includes a support member 10 comprising a pair of collar members 12, 14 fixed to a plurality of fins 16 adapted to be screwed or bolted to the base member 2. Once fixed to the base member 2, the support member 10 is adapted to receive a center post 18. Preferably, the center post 18 is made up of two center post members **18*a* and 18*b* which connect together telescopically to form the center post 18**.

Figure 4:
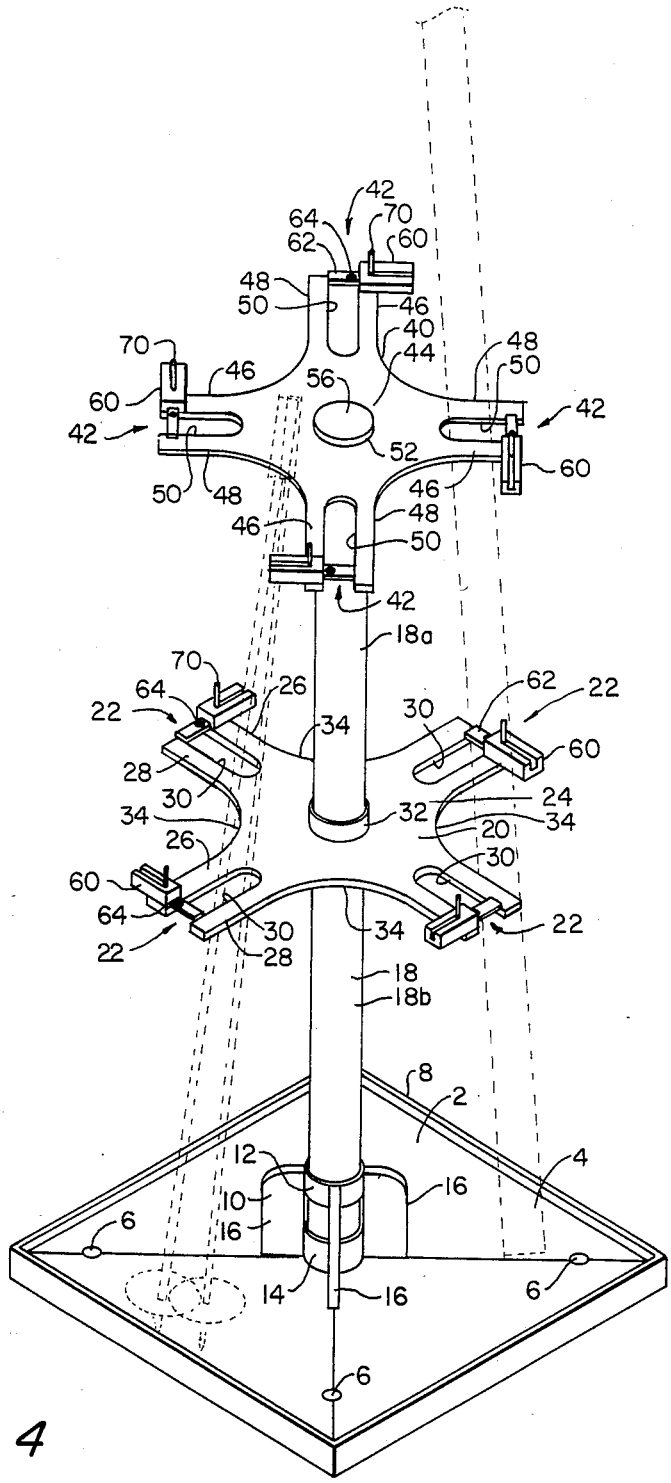
FIG. 4 is a perspective view thereof, with retained skis and ski poles shown in phantom.

The center post 18, upstanding from the base member 2, and supported by the support member 10, is adapted to receive a lower sprocket 20. The lower sprocket 20 is provided with a plurality of receiving stations 22, each receiving station being defined by a hub portion 24 (FIGS. 4 and 5) of the sprocket 20 and first and second fingers 26, 28 extending outwardly from the hub portion 24 generally parallel to each other, the hub portion 24 and the fingers 26, 28 defining a slot 30. The hub portion 24 of the lower sprocket 20 is provided with a central tubular portion 32 of the same internal cross-sectional configuration as the center post 18 and, in the case of a circular configuration, having an inside diameter substantially equal to the diameter of the center post, so that the lower sprocket may be slid onto the center post and into a position substantially as shown in FIG. 4, but such that the frictional engagement of the lower sprocket tubular portion 32 with the center post 18 is sufficient to hold the sprocket in a selected position on the post. Between each of the receiving stations 22 is an opening 34.

The center post 18 is further adapted to receive an upper sprocket 40. Similary to the lower sprocket 20, the upper sprocket 40 is provided with a plurality of receiving stations 42, each receiving station being defined by a hub portion 44 of the sprocket 40 and first and second fingers 46, 48 extending outwardly from the hub portion 44 generally parallel to each other, the hub portion 44 and the fingers 46, 48 defining a slot 50. The hub portion 44 of the upper sprocket 40 is provided with a central tubular portion 52 of the same cross-sectional configuration as the center post 18 and, in the case of a circular configuration, having an inside diameter substantially equal to the diameter of the center post, so that the upper sprocket may be slid onto the center post and into a position substantially as shown in FIG. 4, but such that the frictional engagement of the upper sprocket tubular portion 52 with the center post 18 is sufficient to hold the sprocket in a selected position on the post. To further assist in the placement of the upper sprocket 40 on the post 18, the upper sprocket tubular portion 52 is closed at its upper end 56. Between each of the receiving stations 42 is an opening 54.

Figure 3:
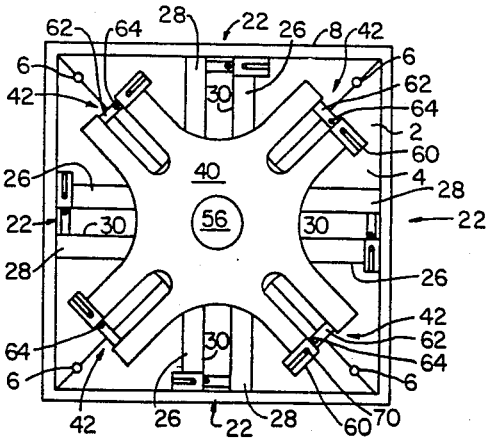
FIG. 3 is a top plan view thereof.

The receiving stations 42 of the upper sprocket 40 are aligned vertically with the openings 34 of the lower sprocket 20. In like manner, the receiving stations 22 of the lower sprocket 20 are aligned vertically with the openings 54 of the upper sprocket 40, as shown in FIGS. 3 and 5.

Each of the receiving stations 22, 42 is preferably provided with a spring-biased lock means 60 at the distal ends of the slots 30, 50. The lock means 60 each include a plunger 62 adapted to bridge the slot between the fingers to substantially close off the slots 30, 50. The plungers 62 may be provided with holes 64 to receive padlocks, or the like (not shown). Each lock means includes a spring (not shown) which biases the plunger 62 to the extended, or closed, position. A grip member 70 is provided by which an operator may open the slot by overcoming the bias of the spring, in known fashion. As an alternative, the lock means may comprise a leaf spring member, or a pair of opposed leaf spring members at the opening of the slots 30, 50 (not shown).

In practice, it is preferable that the base member be on the order of 18 inches by 18 inches, which provides reasonably stable support of the assembly, even when not secured to the floor, and when using longer lengths of skis. The center post members 18*a*, 18*b* are preferably of a length of 24 inches each, giving the stand a total height of almost four feet, again, providing stability when used with longer ski lengths, but still suitable for shorter length skis. The sprockets 20, 40 are 18 inches, side to side, so that the entire assembly is easily fitted into a portable container or approximately 18 inches by 18 inches.

Figure 5:
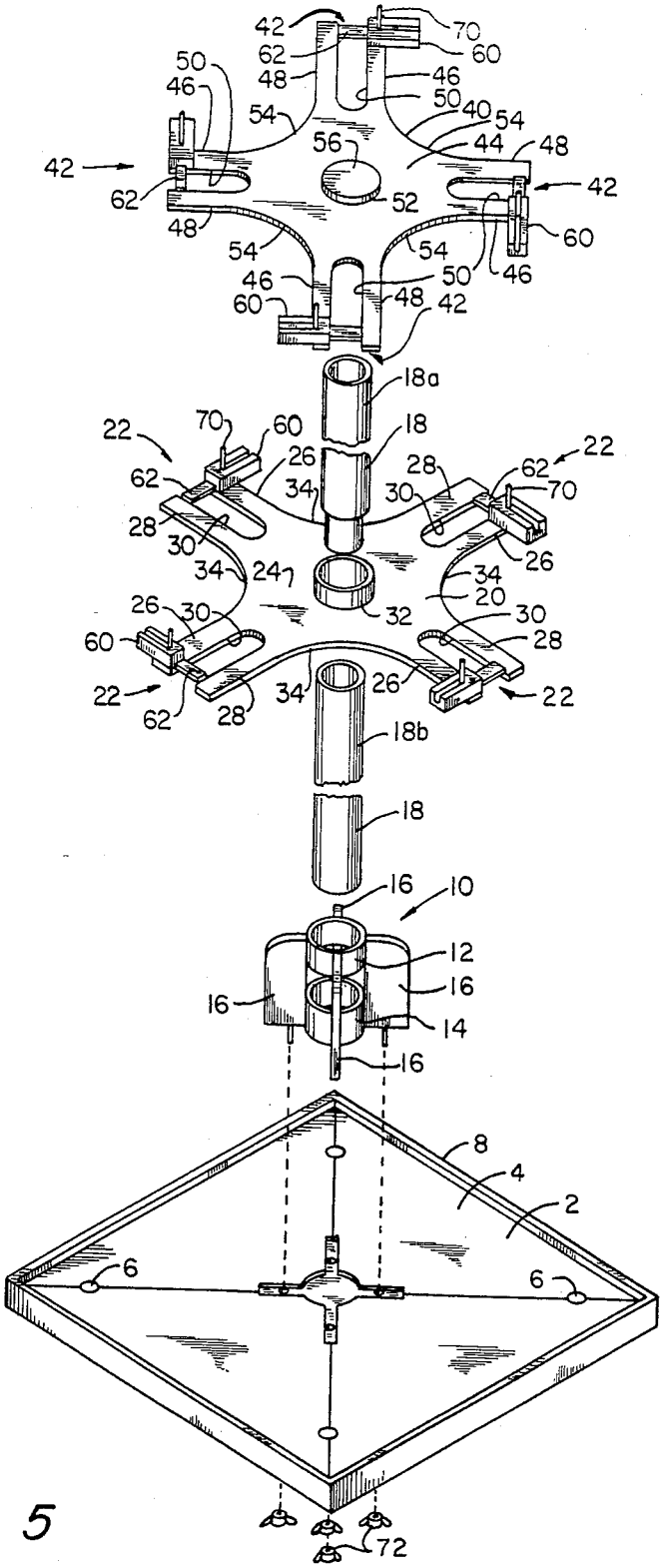
FIG. 5 is an exploded perspective view of the assembly.

In setting up the assembly, the support member 10 is screwed to the base member, as by wing-nuts 72 (FIG. 5). For permanent installations, the base may be screwed or bolted to a floor, using the holes 6. The lower center post member 18*b* is then inserted in the collar members 12, 14. The lower sprocket 20 may then be slid onto the lower center post member, followed by connection of the upper center post member 18*a* to the lower center post member 18*b*, and sliding of the upper sprocket 40 onto the upper center post member 18*a*. The upper sprocket may be slid only so far on the post 18 in view of the end wall 56. The sprockets are positioned such that a receiving station of one sprocket is disposed in alignment with the opening 34, 54 of the other sprocket.

In use, skis are inserted into the slots 50 of the upper sprocket 40, the lock means 60 operating to close off the slots 50. The surface 4 of the base member 2 is slanted such as to cause the skis to lean inwardly, or toward the center post axis, adding to the stability of the assembly. Similarly, ski poles are inserted into the slots 30 of the lower sprocket 20 (FIG. 4).

In the event the skis and poles are wet, or have ice or snow thereon, the inclination of the base member surface 4, and the peripheral lip 8, prevent spillage onto the floor, drippings onto the surface 4 tending to run downwardly, toward the center of the base member.

Thus, there is provided an assembly which is easily broken down into parts small enough to be stored and carried in a portable container, an assembly which is quickly and easily erected for use, and which provides convenient storage of both skis and ski poles, with easy access to either or both.

It is to be understood that the present invention is by no means limited to the particular construction herein disclosed and/or shown in the drawings, but also comprises any modifications or equivalents within the scope of the disclosure. It is further to be understood that the rack assembly herein described and claimed may be used for the retention of elongated objects other than skis and ski pols, and particularly tennis raquets, canoe paddles, shovels, fishing poles, and the like.

Having thus described my invention, what I claim as new and desire to secure by Letter of Patent of the United States is:

1. A rack assembly for elongated objects, said assembly comprising a base portion for disposition on a substantially horizontal floor, a central member upstanding substantially vertically from a central portion of said base portion, a substantially planar lower sprocket member mounted on said central member between the ends of said central member, and a substantially planar upper sprocket member mounted on said central member nearer a free end of said central member than said lower sprocket member, each of said sprocket members having a plurality of radially outwardly extending receiving portions, each of said receiving portions comprising a hub portion and two separated, parallel, radially outwardly extending fingers, each of said fingers comprising an integral, substantially planar extension of said planar sprocket members, each of said sprocket members having peripheral openings disposed between said receiving portions, each of said openings being defined by a further hub portion and two neighboring receiving portions, and a plurality of closure means, each closure means being disposed individually on a first of said two fingers of each of said sprocket member, and biased toward the second of said two fingers to substantially close a receiving portion, the upper and lower sprocket members being of substantially equal outside diameter, each receiving portion of said upper sprocket member being disposed between two of said receiving portions of said lower sprocket member and in alignment with one of said openings of said lower sprocket member as viewed axially of said central member, with said base portion underlying all of said receiving portions and said openings, and a support member adapted for connection to said base portion, said support member including collar means and fins attached to said collar means and disposed to upstand from an upper surface of said base portion when said support member is connected to said base portion, said collar means being shaped complementarily to said central member to receive and retain said central member.

2. The assembly in accordance with claim 1 in which said central member comprises first and second tubular members adapted to telescopic connection to each other, and in which said support member slidably receives said first tubular member, said first tubular member connectingly receives said second tubular member, and said second and first tubular members slidably receive said sprocket members, whereby said base portion, said support member, said first and second tubular members, and said sprocket members may be readily joined to form said assembly in condition for use, or readily disconnected for compact storage and portability.

3. A rack assembly for elongated objects, said assembly comprising a base portion for disposition on a substantially horizontal floor, a central member upstanding substantially vertically from a central portion of said base portion, a substantially planar lower sprocket member mounted on said central member between the ends of said central member, and a substantially planar upper sprocket member mounted on said central member nearer a free end of said central member than said lower sprocket member, each of said sprocket members having a plurality of radially outwardly extending receiving portions, each of said receiving portions comprising a hub portion and two separated, parallel, radially outwardly extending fingers, each of said fingers comprising an integral, substantially planar extension of said planar sprocket members, each of said sprocket members having peripheral openings disposed between said receiving portions, each of said openings being defined by a further hub portion and two neighboring receiving portions, and a plurality of closure means, each closure means being disposed individually on a first of said two fingers of each of said sprocket members, and biased toward the second of said two fingers to substantially close a receiving portion, the upper and lower sprocket members being of substantially equal outside diameter, each receiving portion of said upper sprocket member being disposed between two of said receiving portions of said lower sprocket member and in alignment with one of said openings of said lower sprocket member as viewed axially of said central member, each receiving portion of said lower sprocket member being disposed between two of said receiving portions of said upper sprocket member and in alignment with an opening of said upper sprocket member, as viewed axially of said central member, said closure means each comprising an axially moveable plunger biased toward a closed position, and a grip member fixed to said plunger and manually manipulable to move said plunger against said bias, said base portion underlying all of said receiving portions and said openings.

* * * * *